US011724169B2

(12) United States Patent
Rita et al.

(10) Patent No.: US 11,724,169 B2
(45) Date of Patent: Aug. 15, 2023

(54) STRIKING APPARATUS AND CONFIGURATIONS THEREOF

(71) Applicant: FIGHTER FOUNDRY, LLC, Phoenix, AZ (US)

(72) Inventors: Raymond Rita, Phoenix, AZ (US); Abraham Camacho, Surprise, AZ (US)

( * ) Notice: Subject to any disclaimer, the term of this patent is extended or adjusted under 35 U.S.C. 154(b) by 246 days.

(21) Appl. No.: 17/143,852

(22) Filed: Jan. 7, 2021

(65) Prior Publication Data

US 2022/0212076 A1 Jul. 7, 2022

(51) Int. Cl.

| | |
|---|---|
| ***A63B 69/00*** | (2006.01) |
| ***A63B 21/16*** | (2006.01) |
| ***A63B 23/12*** | (2006.01) |
| ***A63B 71/02*** | (2006.01) |

(52) U.S. Cl.

CPC ..... *A63B 69/004* (2013.01); *A63B 21/1645* (2013.01); *A63B 23/12* (2013.01); *A63B 71/023* (2013.01); *A63B 2209/00* (2013.01); *A63B 2210/50* (2013.01); *A63B 2225/093* (2013.01); *A63B 2244/102* (2013.01); *A63B 2244/104* (2013.01); *A63B 2244/106* (2013.01)

(58) Field of Classification Search

CPC ..... A63B 21/026; A63B 21/1645; A63B 2210/50; A63B 2209/00; A63B 71/023; A63B 2244/102; A63B 2244/104; A63B 2244/106; A63B 23/12; A63B 69/004; A63B 69/20; A63B 69/34

USPC ..... 482/87

See application file for complete search history.

(56) References Cited

U.S. PATENT DOCUMENTS

| | | | | | |
|---|---|---|---|---|---|
| 4,662,630 | A * | 5/1987 | Dignard | A63B 69/004 | 482/83 |
| 4,836,533 | A * | 6/1989 | Dong | A63B 69/004 | 482/83 |
| 5,921,896 | A * | 7/1999 | Boland | A63B 69/32 | 482/84 |
| 6,309,327 | B1 * | 10/2001 | Hallberg | A63B 69/34 | 482/90 |
| 6,575,879 | B1 * | 6/2003 | Harney | A63B 69/34 | 473/441 |
| 6,599,206 | B1 * | 7/2003 | Forrest, Sr. | A63B 69/34 | 473/441 |
| 6,942,585 | B1 * | 9/2005 | Krause | A63B 69/002 | 473/445 |
| 9,022,904 | B1 * | 5/2015 | Dorsey, III | A63B 69/004 | 482/88 |
| 9,737,780 | B1 * | 8/2017 | Khunkhun | A63B 69/305 | |
| 10,293,234 | B1 * | 5/2019 | Schlegel | A63B 69/34 | |
| 10,603,565 | B1 * | 3/2020 | Gibson | B62B 5/0076 | |
| 11,077,348 | B1 * | 8/2021 | Stokke | A63B 69/0059 | |

(Continued)

*Primary Examiner* — Megan Anderson
*Assistant Examiner* — Thao N Do
(74) *Attorney, Agent, or Firm* — Weiss & Moy, PC; Jeffrey D. Moy

(57) ABSTRACT

An exercise assembly has a target. A plurality of compression blades is coupled to the target. A mounting plate is coupled to the plurality of compression blades. A mounting chassis is coupled to the mounting plate securing the exercise assembly to a building structure, wherein the mounting chassis moves in a forward and rearward direction relative to the building structure. A plurality of fasteners cis coupled to the mounting chassis securing the exercise assembly to the building structure.

19 Claims, 7 Drawing Sheets

(56) References Cited

U.S. PATENT DOCUMENTS

| | | | | |
|---|---|---|---|---|
| 2002/0147061 | A1* | 10/2002 | Krause | A63B 69/34 473/445 |
| 2004/0026863 | A1* | 2/2004 | Cho | F41J 3/0047 273/348.5 |
| 2007/0249473 | A1* | 10/2007 | Robinson | A61K 47/14 482/83 |
| 2009/0098985 | A1* | 4/2009 | Gonzalez | A63B 69/34 482/83 |
| 2009/0264262 | A1* | 10/2009 | Brenner | A63B 69/34 482/83 |
| 2013/0059699 | A1* | 3/2013 | Brenner | A63B 69/004 482/83 |
| 2013/0196794 | A1* | 8/2013 | Wheel | A63B 69/0091 473/422 |
| 2014/0066267 | A1* | 3/2014 | Solah | A63B 69/0053 482/83 |
| 2014/0128227 | A1* | 5/2014 | Ladas | A63B 69/20 482/84 |
| 2015/0209641 | A1* | 7/2015 | Yevgeniyovych | A63B 69/20 482/83 |
| 2017/0014699 | A1* | 1/2017 | Nelson | A63B 69/205 |
| 2018/0099199 | A1* | 4/2018 | Rita | A63B 69/004 |
| 2019/0329111 | A1* | 10/2019 | Moran | A63B 69/004 |
| 2019/0344145 | A1* | 11/2019 | Rita | A63B 69/004 |
| 2020/0038731 | A1* | 2/2020 | Diaz | A63B 69/34 |
| 2020/0171377 | A1* | 6/2020 | Wilhelmi | A63B 47/002 |
| 2022/0212076 | A1* | 7/2022 | Rita | A63B 69/004 |

* cited by examiner

STRIKING APPARATUS AND CONFIGURATIONS THEREOF

RELATED APPLICATIONS

The present application is related to U.S. Pat. No. 10,398,958 entitled, "Striking Apparatus and Configurations Thereof", filed Oct. 6, 2016, and having U.S. Ser. No. 15/287,469 and is further related to U.S. patent application entitled, "Striking Apparatus and Configurations Thereof", filed Jul. 29, 2019, and having U.S. Ser. No. 15/287,469 both in the name of Raymond Rita, and both of which are incorporated herein by reference in its entirety.

TECHNICAL FIELD

This disclosure generally relates to an exercise or training device, and more particularly, to an adjustable striking apparatus that may be mounted to a door end assembly.

BACKGROUND

Athletes, or others who exercise, may enhance their workout through striking apparatuses. Boxers, kick-boxers, martial artists, or others may exercise or train through these types of apparatuses. Striking apparatuses may typically include pads or cushions that simulate the density, shape and/or weight of an opponent. One commonly used striking apparatus is constructed from leather and encases a material such as sawdust or sand. The materials, along with the encasing, may absorb hits through the user's feet, hands and/or other extremity. These hits may occur directly and/or on the sides of the striking apparatus.

Striking apparatuses may currently be supported from a ceiling, ceiling and floor, wall or portable stand. Each of these, however, has drawbacks. For example, attaching the striking apparatus to the ceiling, floor, and/or wall may use permanent embedded clasps. Because of this, the striking apparatus may be difficult to move and subjected to certain fixed locations corresponding to the clasps. Furthermore, and in portable striking apparatuses, inadequate structure may be provided that allows the apparatus to fully move unintentionally.

The present disclosure provides a striking apparatus and configurations thereof that solve the described concerns. Other benefits and advantages will become clear from the disclosure provided herein and those advantages provided above are for illustration

SUMMARY

This summary is provided to introduce a selection of concepts in a simplified form that are further described below in the DESCRIPTION OF THE DISCLOSURE. This summary is not intended to identify key features of the claimed subject matter, nor is it intended to be used as an aid in determining the scope of the claimed subject matter.

In accordance with one aspect of the present disclosure, an exercise assembly is provided. The exercise assembly has a target. A plurality of compression blades is coupled to the target. A mounting plate is coupled to the plurality of compression blades. A mounting chassis is coupled to the mounting plate securing the exercise assembly to a building structure. A plurality of fasteners is coupled to the mounting chassis securing the exercise assembly to the building structure. The mounting chassis and the plurality of fasteners allow compression in a forward, rearward and side to side directions relative to the building structure.

BRIEF DESCRIPTION OF DRAWINGS

The novel features believed to be characteristic of the disclosure are set forth in the appended claims. In the descriptions that follow, like parts are marked throughout the specification and drawings with the same numerals, respectively. The drawing figures are not necessarily drawn to scale and certain figures may be shown in exaggerated or generalized form in the interest of clarity and conciseness. The disclosure itself, however, as well as a preferred mode of use, further objectives and advantages thereof, will be best understood by reference to the following detailed description of illustrative embodiments when read in conjunction with the accompanying drawings, wherein:

DESCRIPTION OF THE DISCLOSURE

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or mom." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

The present disclosure relates to a striking apparatus and provides multiple configurations to that apparatus. More particularly, this disclosure describes the striking apparatus having a target that may be secured on a door end assembly. In one illustrative embodiment, the target may be coupled to a compression device having a plurality of compression blades. A mounting plate secures the target at a defined angle relative to a mounting chassis. The mounting chassis may secure the striking apparatus to the door end assembly through at least one fastener.

Figure 1:
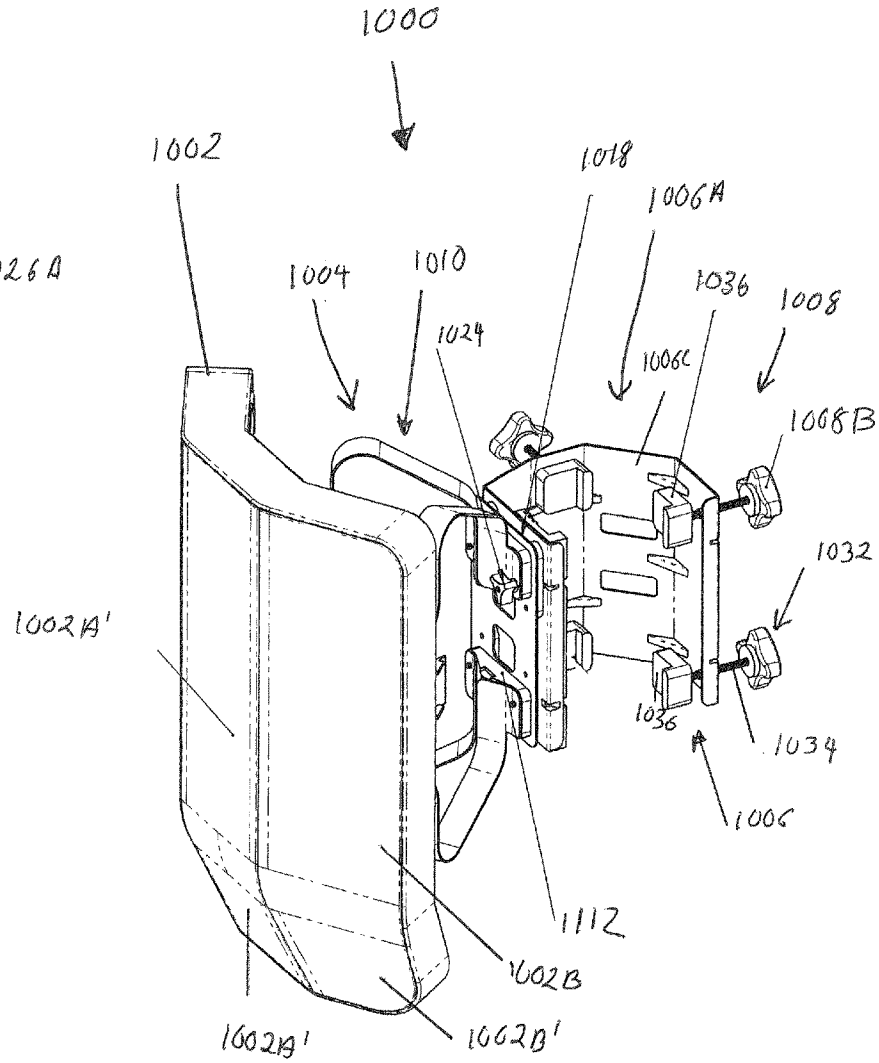
FIG. 1 is a perspective view of an exemplary striking apparatus in accordance with one aspect of the present disclosure.
Figure 2:
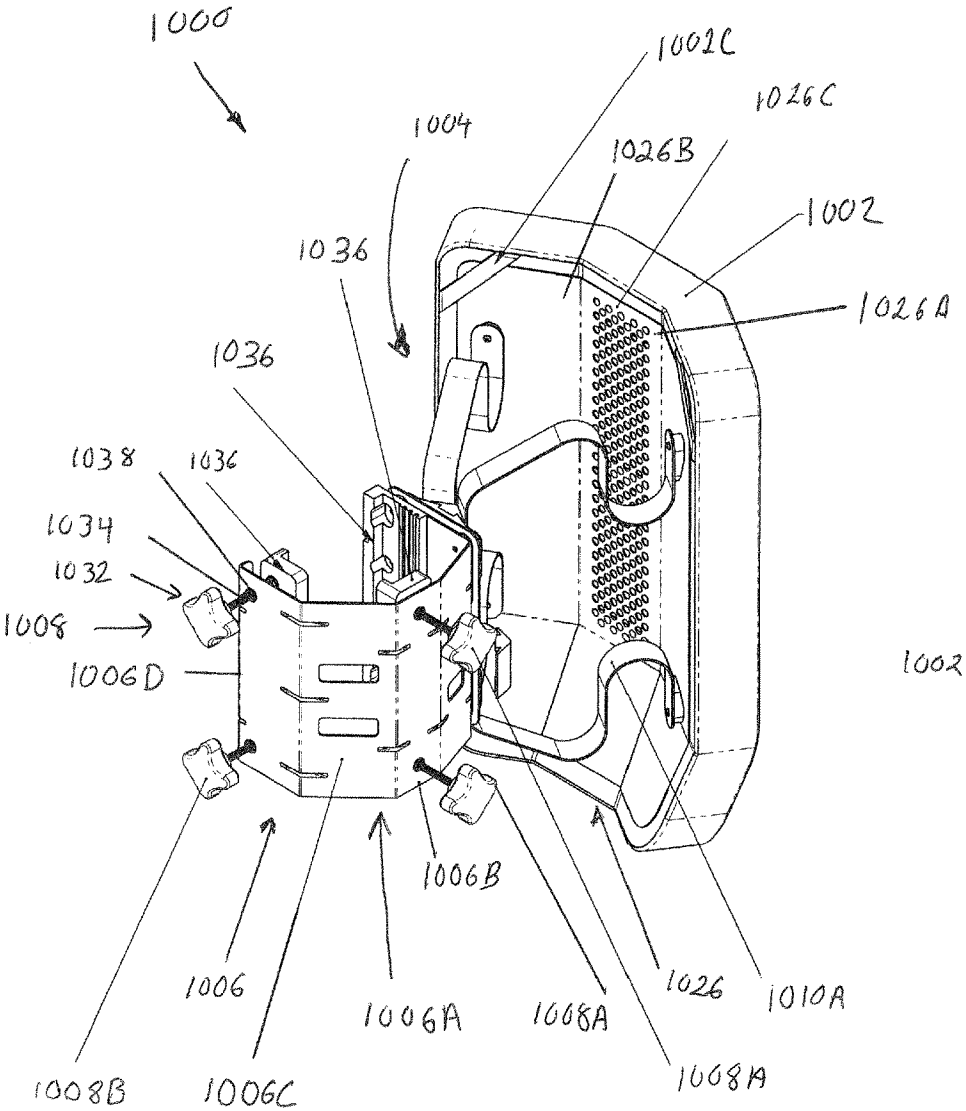
FIG. 2 is a rear perspective view of the exemplary striking apparatus of FIG. 1 in accordance with one aspect of the present disclosure.
Figure 3:
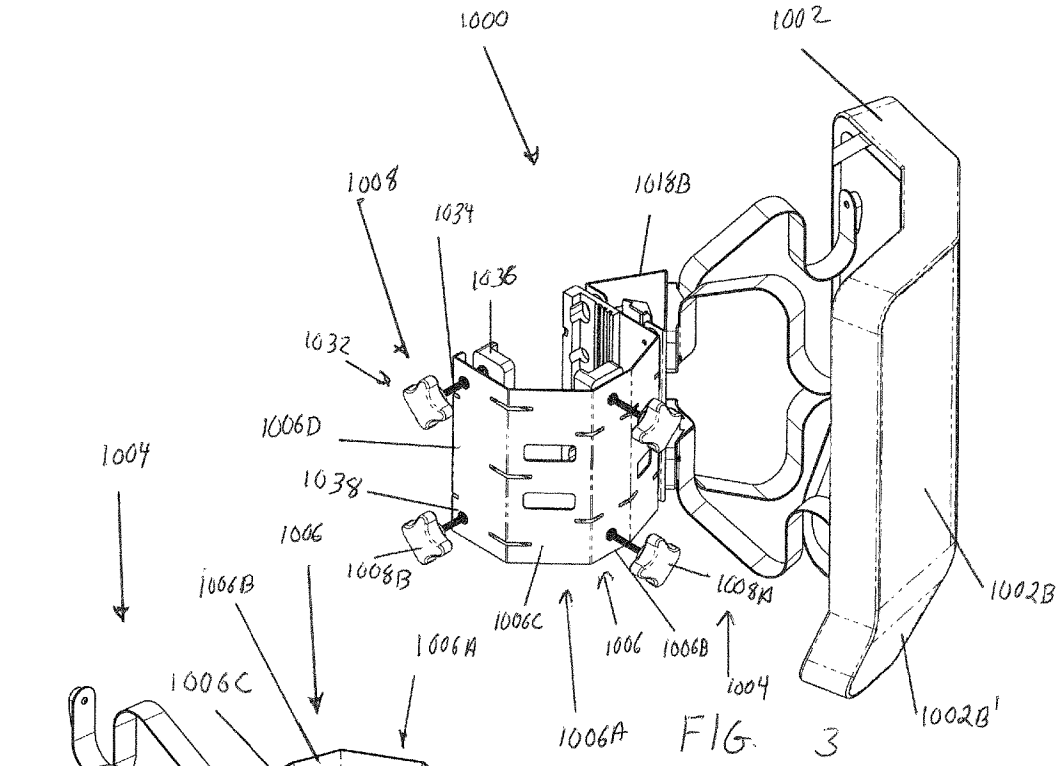
FIG. 3 is a perspective view of an exemplary mounting unit used in the striking apparatus of FIG. 1 in accordance with one aspect of the present disclosure.
Figure 5:
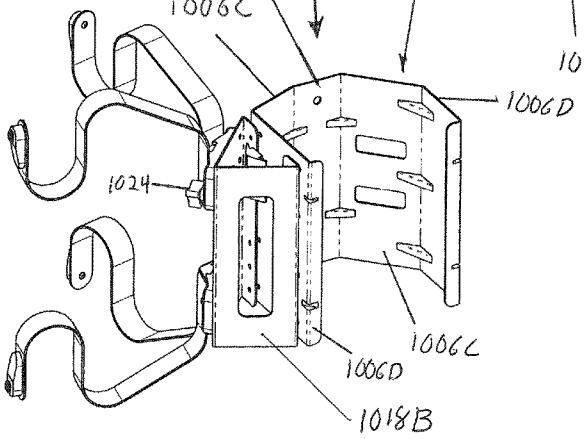
FIG. 5 is a perspective view of an exemplary mounting unit used in the striking apparatus of FIG. 4 in accordance with one aspect of the present disclosure.
Figure 4:
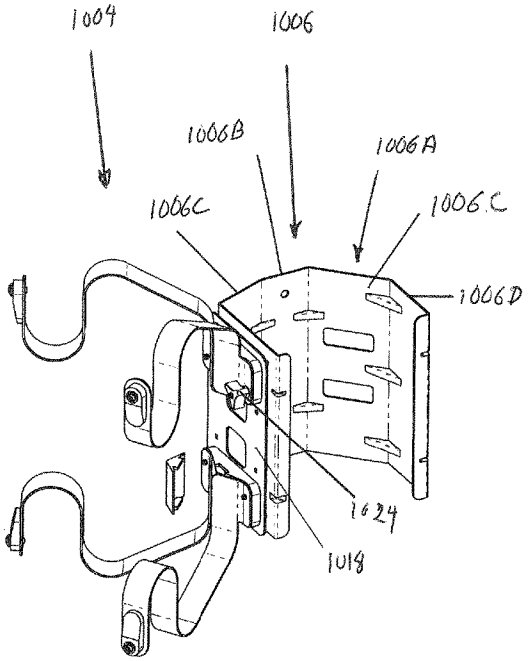
FIG. 4 is a perspective view of an exemplary striking apparatus in accordance with one aspect of the present disclosure.
Figure 6:
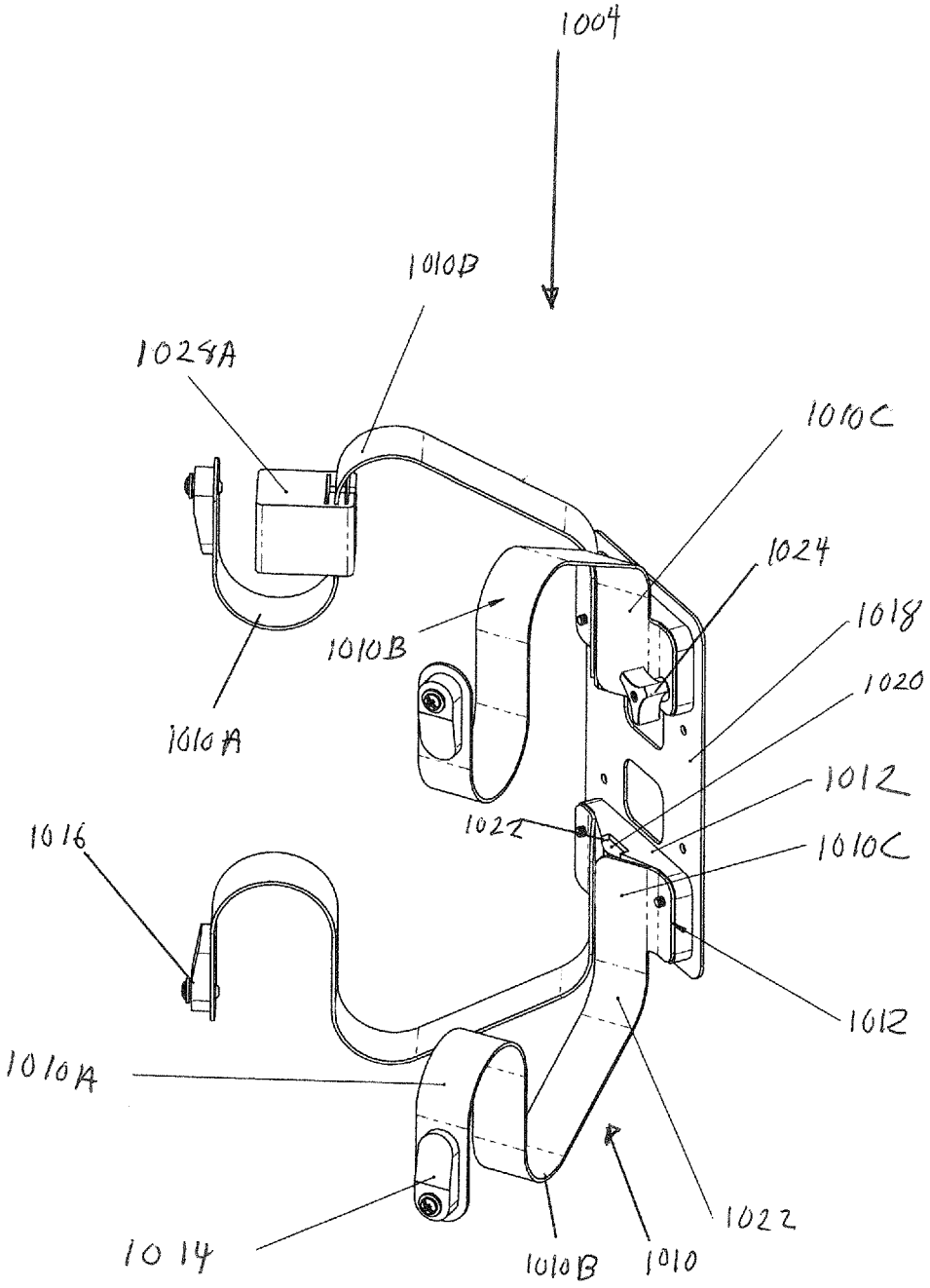
FIG. 6 is a perspective view of an exemplary spring mechanism used in the striking apparatus of FIG. 1 and FIG. 4 in accordance with one aspect of the present disclosure.
Figure 7:
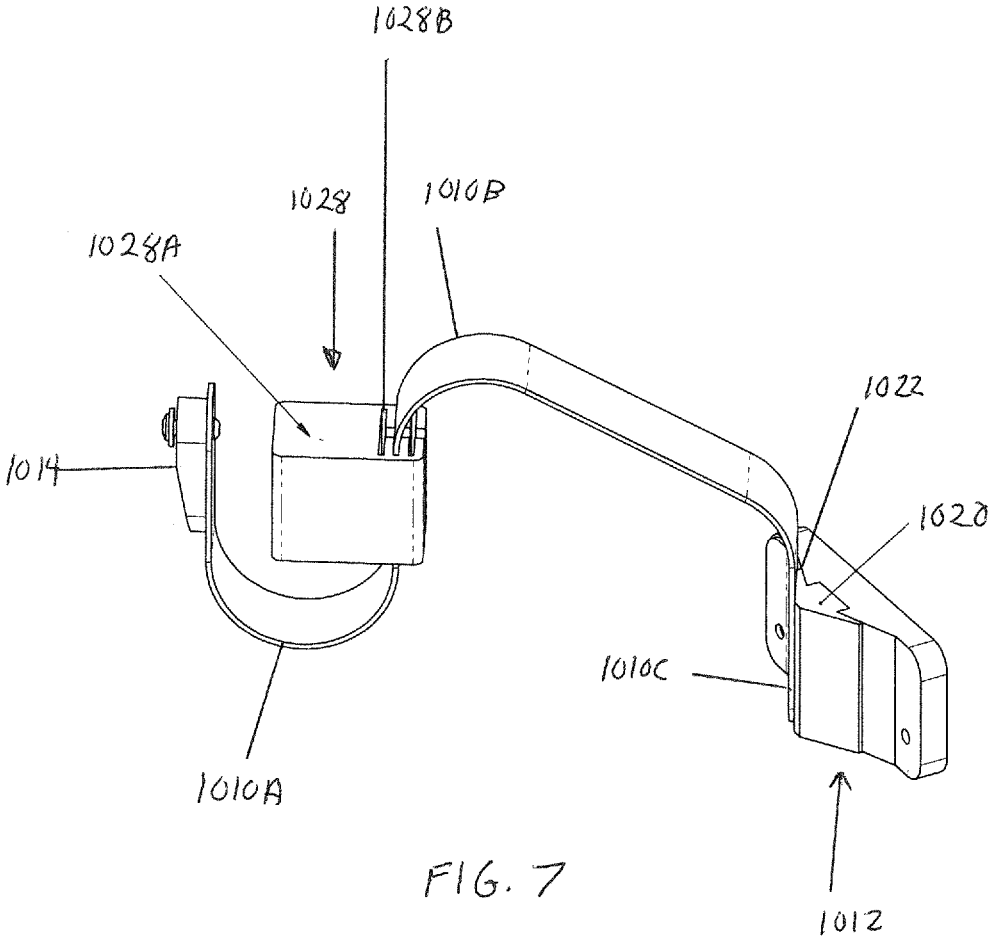
FIG. 7 is a perspective view of an exemplary spring blade of the spring mechanism used in the striking apparatus of FIG. 1 and FIG. 4 in accordance with one aspect of the present disclosure.
Figure 8:
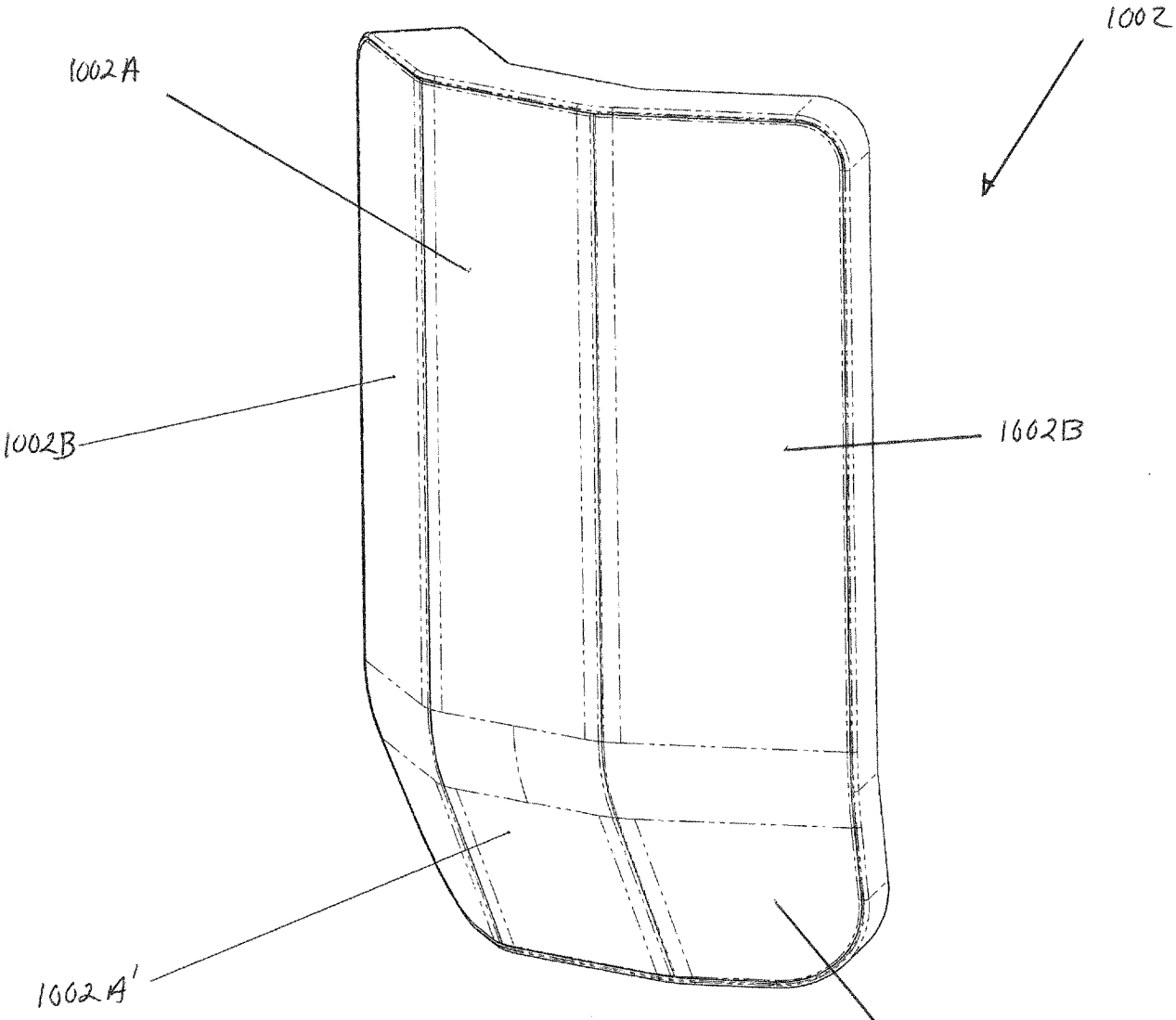
FIG. 8 is a perspective view of an exemplary striking pad used in the striking apparatus of FIG. 1 and FIG. 4 in accordance with one aspect of the present disclosure.
Figure 9:
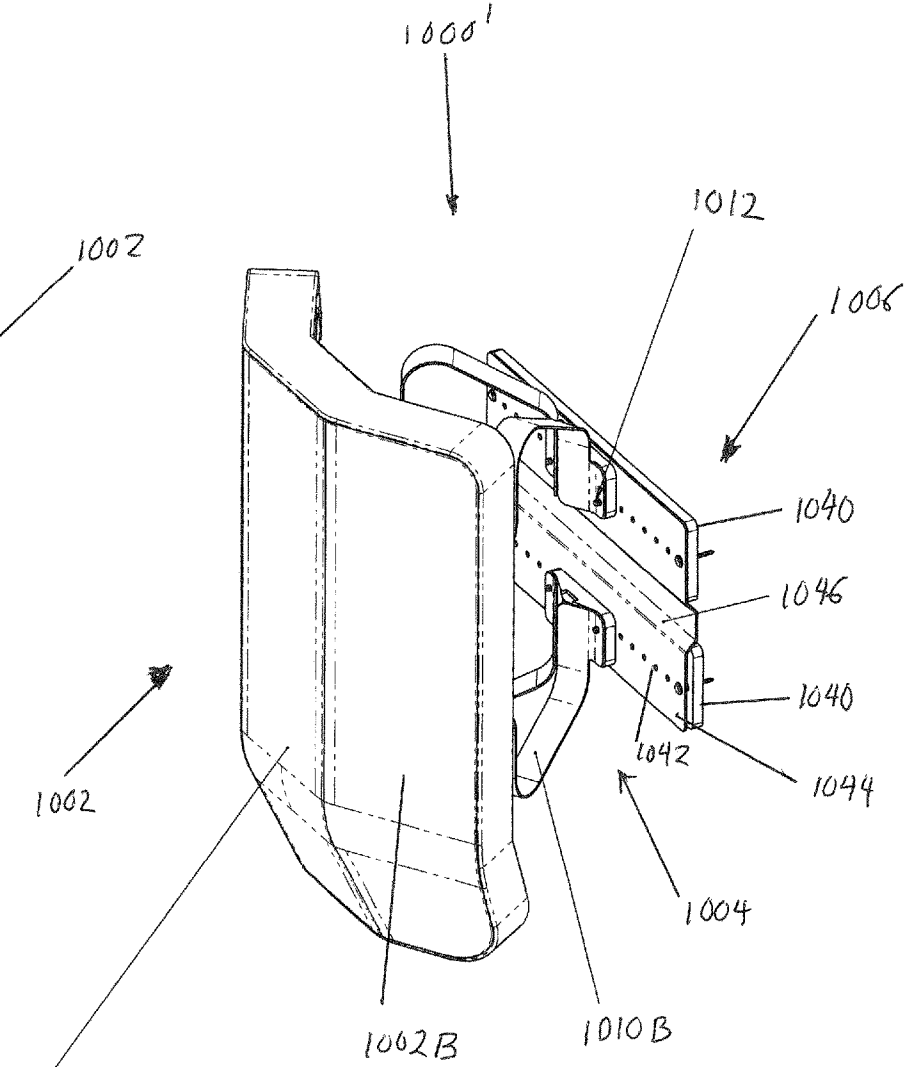
FIG. 9 is a front perspective view of an exemplary striking apparatus in accordance with one aspect of the present disclosure.
Figure 10:
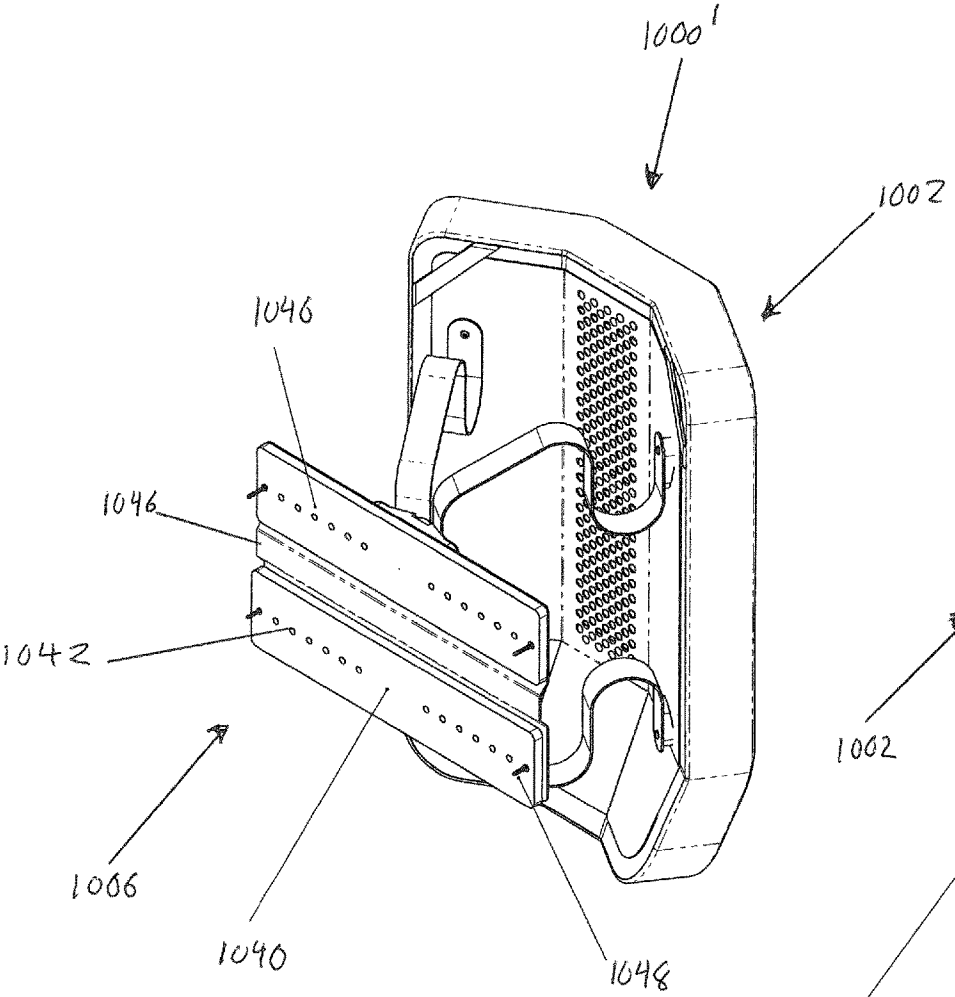
FIG. 10 is a rear perspective view of the exemplary striking apparatus of FIG. 9 in accordance with one aspect of the present disclosure.
Figure 11:
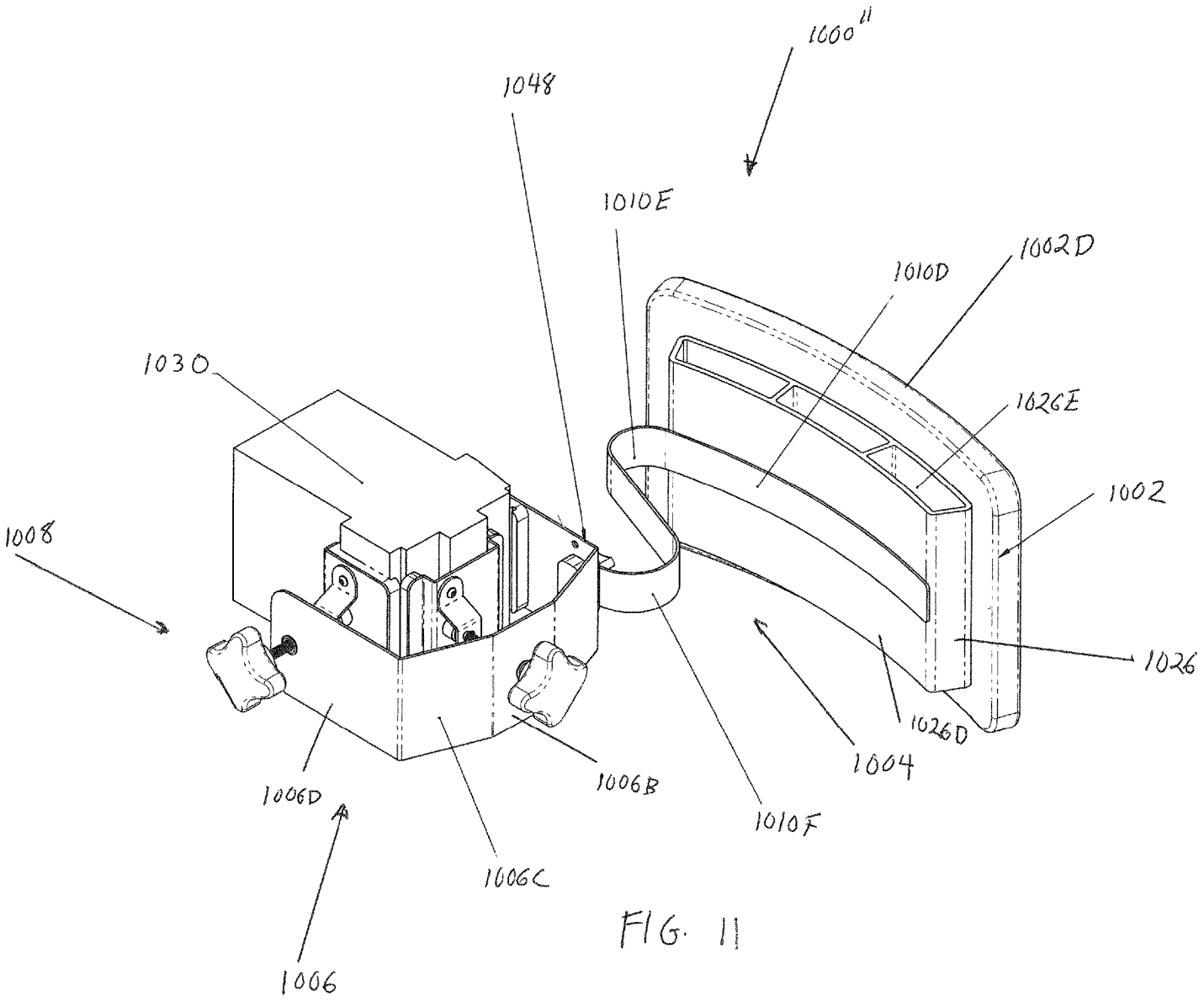
FIG. 11 is a front perspective view of an exemplary striking apparatus in accordance with one aspect of the present disclosure.

Numerous other modifications or configurations for the striking apparatus will become apparent from the description provided below. Advantageously, the height of the target may be adjusted depending on its placement on the door end assembly. The apparatus may also be sturdy allowing more forceful blows as it takes advantage of studs within the door end assembly. The apparatus may be more easily portable than other devices. Other advantages will become apparent from the description provided below. The present disclosure will provide the components of the striking apparatus in FIGS. 1 through 5 will show the components of the striking apparatus which is set at predefined exemplary angles. FIGS. 6 through 8 will depict details of the apparatus. FIGS. 9 through 10 will show the components of another embodiment of the striking apparatus which is mounted to a wall. FIG. 11 will show the components of another embodiment of the striking apparatus.

Referring to FIGS. 1 through 8, one embodiment of an exemplary striking apparatus 1000 in accordance with one aspect of the present disclosure may be disclosed. The striking apparatus 1000 may include, but is not limited to, a target 1002, a compression mechanism 1004, a mounting chassis 1006, and fasteners 1008. The striking apparatus 1000, for purposes of this disclosure, may also be referred to as an exercise or training assembly, device or apparatus. The striking apparatus 1000 may be placed at a number of locations where appropriate and secured by the fastener 1008. Fewer or more components may be incorporated into the apparatus 1000 and is not limited to those shown.

The striking apparatus 1000 may be construed from a number of different materials. For example, the striking apparatus 1000 may be made of plastic, wood, rubber, foam, metal or combinations thereof. Furthermore, different components within the striking apparatus 1000 may be made of different materials. For example, the compression mechanism 1004 and the mounting unit 1006 may be made of metal while the target 1002 may be formed of foam or other materials as described below. Various combinations of materials may be used.

The target 1002 may also be made of materials different from the compression mechanism 1004, the mounting unit 1006 and other supporting structures. The outside or cover of the target 1002 may be made of, for example, leather, synthetic materials such as vinyl or canvas. Typically, this material may be selected based on its resistance to tears or cuts. Internally, the target 1002 may include foam, grains, sand, rags or other materials. These materials may be encased by the leather, synthetic materials or canvas.

Various sizes and shapes of the target 1002 may be provided. Different sparring, exercising or training may be enhanced or developed through the striking apparatus 1000. This may include hits or blows from a boxer, kickboxer, and/or fighter to the target 1002. Direct hits may occur to the target 1002 and in addition, blows to the sides 1002B of the target 1002 may occur. The target 1002 may be formed of a center section 1002A. The center section 1002A may be formed of a substantially elongated member which is planer. A bottom area of the center section 1002A' may be curved and/or angled inwards. The center section 1002A may be folded at its sides 1002B in accordance with one embodiment. Each side 1002B may be folded at approximately a same angled. A bottom area 1002B' of each side 1002B may be curved and/or angled inwards at a same and/or similar angle as the bottom area 1002A' of the center section 1002A. The target 1002 may mimic the shape of an opponent for providing a realistic experience.

In one embodiment, the target 1002 may incorporate varying types of materials within different sections. For example, the center section 1002A of the target 1002 may include less abrasive materials for direct shots as they are associated more typically with hand shots where the user's hands may not be protected by padding. Sides 1002B of the target 1002 may incorporate rigid materials. These types of materials may take on the wear and tear of the user's footwear. The target 1002 may be replaceable and switched in and out with other types of targets suitable for the user.

A backplate 1026 may be attached to a rear surface of the target 1002. The backplate 1026 may be used to help to secure the target 1002 to the compression mechanism 1004. In accordance with one embodiment, the target 1002 may be removably attached to the backplate 1026. The target 1002 may have a sleeve 1002C formed on the rear surface of the target 1002. The sleeve 1002C may be used to guide and removably secure the target 1002 to the backplate 1026.

The backplate 1026 may be farmed of a sturdy material such as metal or strong plastic. The backplate 1026 may be formed in a similar shape to the target 1002. Thus, the backplate 1026 may have a center section 1026A which may be folded at its sides 1026B. A bottom area of the center section 1026A and each side 1026B may be curved and/or angled inwards. The backplate 1026 may have a plurality of perforations 1026C formed therethrough. The perforations 1026C may help to dampen noise levels when a user is striking the target 1002. In the present embodiment, the perforations 1026C may be shown to be formed through the center section 1026A. However, the perforations 1026C may be formed through the side sections 1026B as well.

The target 1002 of the striking apparatus 1000 may be coupled to the compression mechanism 1004. The compression mechanism 1004 may be formed of a plurality of compression blades 1010. The compression blades 1010 may absorb the hits or blows from the user. The compression blades 1010 may be welded into the back of the target 1002 or fastened through screws or other attachment mechanisms. In accordance with one embodiment, the compression blades 1010 may be attached to the backplate 1026. While four (4) compression blades 1010 may be shown in different FIGURES, more may exist within the striking apparatus 1000 which will become apparent from the disclosure provided below.

The compression blades 1010 may be made of a sturdy material such as metal or strong plastic. In one embodiment, the compression blades 1010 may be made of heavy rubber. The compression blades 1010 may have a coating applied thereto for sound dampening which may be caused by vibrations. The coating may be a rubberized coating, a foam coating or similar sound dampening coatings.

The compression blades 1010 may provide rigidity from direct hits or side blows. As may be shown in FIG. 7, the compression blades 1010 may be formed of a strip of material configured to have a "U" shaped section 1010A. A first leg of the "U" shaped section 1010A may be attached to the target 1002. A curve section 1010B which may extend up from and curve down and away from the second leg of the "U" shaped section 1010A. A vertical leg 1010C may extend down from the curve member 1010B.

Attached to the first leg of the "U" shaped section 1010A may be a shock absorbing device 1014. The shock absorbing device 1014 may help to absorb and dampen the forces created by the user hitting/punching the target 1002. An opening 1016 may be formed in the shock absorbing device 1014. The opening 1016 may be used to allow screws or other attachment mechanisms to pass through the shock absorbing device 1014 in order to secure the compression blades 1010 to the back of the target 1002.

Attached to the vertical leg 1010C may be a mounting unit 1012. The mounting unit 1012 may be used to secure each of the compression blades 1010 to a mounting plate 1018. The vertical leg 1010C may be secured to a first surface of the mounting unit 1012. A second and opposing surface of the mounting unit 1012 may be secured to the mounting plate 1018. A shock absorbing member 1020 may be positioned within the mounting unit 1012. The shock absorbing member 1020 may help to absorb and dampen the forces created by the user hitting/punching the target 1002. In accordance with one embodiment, the mounting unit 1012 may be configured to have a channel 1022 formed therein. The absorbing member 1020 may be positioned within the channel 1022. In accordance with one embodiment the channel 1022 formed in the mounting unit 1012 may be a "V" shaped channel.

In accordance with one embodiment, the compression blades 1010 may be attached to backplate 1026 so that the compression blades 1010 attached to an upper area of the backplate 1026 have the open end of the "U" shaped section 1010A positioned upward. The compression blades 1010 attached to a lower area of the backplate 1026 have the open end of the "U" shaped section 1010A positioned downward.

To increase the resistance of the compression blades 1010, a resistance device 1028 may be attached to one or more of the compression blades 1010. The resistance device 1028 may help to stiffen the compression blades 1010 thereby limiting the amount of compression. In accordance with one embodiment, the resistance device 1028 may by attached to the "U" shaped section 1010A of the compression blades 1010. The resistance device 1028 may limit an amount of movement the legs of the "U" shaped section 1010A move inwards thereby providing additional resistance. In accordance with one embodiment, the resistance device 1028 may be formed of a block 1028A. The block 1028A may be held within the "U" shaped section 1010A of the compression blades 1010. The block 1028A may be formed of rubber, a harden foam material or similar materials. One or more slots 1028B may be formed through the block 1028A. The slots 1028B may be of a similar width to the leg of the "U" shaped section 1010A of the compression blades 1010. The leg of the "U" shaped section 1010A of the compression blades 1010 may be inserted into one of the slots 1028B thereby securing the block 1028A between the legs of the "U" shaped section 1010A of the compression blades 1010. The slots 1028B may allow different amount of the block 1028A to be held within the "U" shaped section 1010A of the compression blades 1010 thereby altering an amount of resistance. For example, if more of the block 1028A is held within the "U" shaped section 1010A of the compression blades 1010, more resistance may be provided.

An attachment device 1024 may be used to secure the mounting unit 1012 to the mounting plate 1018. In accordance with one embodiment, the attachment device 1024 may allow a user to removably mount the compression mechanism 1004 to the mounting plate 1018. The attachment device 1024 may be a locking screw device or similar mechanism.

The mounting plate 1018 may be used to secure the compression mechanism 1004 to the mounting chassis 1006. The mounting plate 1018 may be used to hold the compression mechanism 1004 and hence the target 1002 at a desired angle. In accordance with the embodiment shown in FIGS. 1, 2 and 4, the mounting plate 1018 may be flat plate member 1018A thereby securing the target 1002 parallel to the front and rear surface of the mounting plate 1018. Alternatively, the mounting plate 1018 may be formed of a triangular prism structure 1018B. The triangular prism structure 1018B may be hollow with one surface of the triangular prism structure 1018B attached to the mounting chassis 1006 and a second surface of the triangular prism structure 1018B used to hold the compression mechanism 1004 and hence the target 1002 at an angle relative to the mounting chassis 1006.

A mounting chassis 1006 and fasteners 1008 may be included on the striking apparatus 1000. The mounting chassis 1006 and fasteners 1008 may be used to secure the striking apparatus 1000 to the door end assembly 1030 (See FIG. 11). The mounting chassis 1006 may be substantially elongated and may be removably coupled to the door end assembly 1030. The fasteners 1008, which may come in a variety of forms and shapes, may be used to secure the striking apparatus 1000 to the door end assembly 1030 through the mounting chassis 1006. Through the fasteners 1008, the mounting chassis 1006 may be secured, yet easily unhinged or removed such that the striking apparatus 1000 may be moved or relocated to another location.

As described briefly above, the striking apparatus 1000 may be secured to a door end assembly 1030. The height of the striking apparatus 1000, and thus the target 1002, may be adjusted on the door end assembly 1030. For example, taller users may adjust the mounting chassis 1006 of the striking apparatus 1000 and secure the fasteners 1008 to the door end assembly 1030 at a higher position.

The door end assembly 1030 may be found in a number of different locations. Furthermore, the striking apparatus 1000, while depicted as being coupled to a door end assembly 1030, may be also fixed to other locations where the mounting chassis 1006 and fasteners 1008 may tie the striking apparatus 1000 securely, for example, at a sturdy post such as a pole. Variations for the mounting chassis 1006 and fasteners 1008 may be used to tighten the striking apparatus 1000 to the pole. For example, straps or other mechanical fasteners may be used.

In accordance with one embodiment, the mounting chassis 1006 may be formed of a multi-angle mounting chassis 1006A. The multi-angle mounting chassis 1006A may be formed of a first plate 1006B. A pair of angled plates 1006C may be attached to opposing sides of the first plate 1006B. The pair of angled plates 1006C may angle out and away from the first plate 1006B at approximately the same angle. An "L" shaped plate 1006D may extend up from an end of each of the pair of angled plates 1006C to form multi-angle mounting chassis 1006A. The multi-angle mounting chassis 1006A may be designed such that the first plate 1006B may be positioned against a front surface of the door end assembly 1030. The bottom leg of each of the pair of angled plates 1006C may extend around a rear surface of the door end assembly 1030.

A plurality of fasteners 1008 may be used to secure the mounting chassis 1006 of the striking apparatus 1000 to the door end assembly 1030. In the embodiments shown, a pair of side fasteners 1008B may be attached to each of the "L" shaped plates 1006D. As may be shown in the FIGURES, pair of side fasteners 1008B may be vertically aligned. A pair of front fasteners 1008A may be attached to the first plate 1006B. As may be shown in the FIGURES, pair of front fasteners 1008A may be vertically aligned. However, fewer or more fasteners 1008 may be used than that shown. The fasteners 1008 may be secured or released such that the striking apparatus 1000 may be portable and easily affixed to the door end assembly 1030.

In accordance with one embodiment, each of the fasteners 1008, may include, but is not limited to, a knob 1032, a threaded shaft 1034 and a door trim holder 1036. Each of the threaded shafts 1034 may engage a corresponding threaded opening 1038 formed in the mounting chassis 1006 or alternatively a threaded nut attached to an opening formed in the mounting chassis 1006. In accordance with one embodiment, the door trim holder 1036 is an "L" shaped door trim holder. Fewer or more components may be provided in the fasteners 1008 and are not limited to those shown.

Each of the door trim holders 1036 may be placed on different surfaces of the door end assembly 1030. The knob 1032 may allow the user to rotate the threaded shafts 1034 within the corresponding threaded opening 1038 in a first direction to tighten each of the fasteners 1008 so that the door trim holders 1036 engages and presses against a corresponding surface of the door end assembly 1030. In a similar manner, the knob 1032 may be rotated in a second direction loosen each of the fasteners 1008. The multi-angle mounting chassis 1006A and fasteners 1008 may allow compression in a forward and rearward direction as well as in a side-to-side direction relative to the door end assembly 1030.

Referring to FIGS. 19 through 20, another embodiment of the striking apparatus 1000' may be seen. The striking apparatus 1000' may have the target 1002 and the compression mechanism 1004 and a mounting chassis 1006. However, in this embodiment, the mounting chassis 1006 may be used to permanently mount the striking apparatus 1000' to a wall or other flat surface.

The mounting chassis 1006 may be formed of a pair of board members 1040. The board members 1040 may be planer and of similar sizes. In the present embodiment, the board members 1040 may be rectangular in shape. A plate 1044 may be secured to a front surface of the pair of board members 1040. The plate 1044 may be used to hold the pair of board members 1040 and provide additional support. The plate 1044 may be folded to have a channel 1046 running down a width of the plate 1044. The channel 1046 may separate the pair of board members 1040 such that one of the pair of board members 1040 is positioned above the channel 1046 and the other of the pair of board members 1040 is positioned above the channel 1046. The channel 1046 may had a depth such that a rear surface 1046A of the channel 1046 is approximately planer with a back surface of the pair of board members 1040.

A plurality of holes 1042 may be formed through each of the pair of board members 1040. The plurality of holes 1042 may further extend through the plate 1044. The holes 1042 may run along a width of each of the pair of board members 1040 and may be aligned such that the holes 1042 on each of the pair of board members 1040 are aligned along the width and may further be aligned with a corresponding hole 1042 on the other of the pair of board members 1040. Fasteners 1048 may be provided to secure the striking apparatus 1000' to a wall or other flat surface. The fasteners 1048 may be screws, nails or similar types of fasteners. The fasteners 1048 may be positioned through one or more of plurality of holes 1042 through each of the pair of board members 1040 to permanently mount the striking apparatus 1000' to a wall or other flat surface.

Referring to FIG. 21, another embodiment of the striking apparatus 1000" may be seen. The striking apparatus 1000" may have the target 1002, a compression mechanism 1004 and a mounting chassis 1006 with fasteners 1008. In this embodiment, the target 1002 may be formed of a single section 1002D which may be rectangular in shape and which may be curved and/or bowed in nature.

A backplate 1026 may be attached to a rear surface of the target 1002. The backplate 1026 may be used to help to secure the target 1002 to the compression mechanism 1004. In the present embodiment shown, the backplate 1026 may be formed of a base member 1026D. The base member 1026D may be curved and/or bowed in nature to conform to a shape of the target 1002. A plurality of channels 1026E may run through the base member 1026D. In accordance with the present embodiment, the plurality of channels 1026E may run vertically through the base member 1026D. The plurality of channels 1026E may be used to dampen the sounds made when using the striking apparatus 1000".

The compression mechanism 1004 may be formed of a single compression blade 1010. The compression blade 1010 may be attached to the backplate 1026 in the same or similar manner as disclosed in previous embodiments. In the present embodiment shown, the compression blade 1010 may be an "S" shaped compression blade 1010D. The top portion of the "S" shaped compression blade 1010D may be shaped to nature to conform to a shape of the target 1002 and the base member 1026D of the backplate 1026. The curved nature of the top portion of the "S" shaped compression blade 1010D may be used to absorb an initial force applied to the target 1002. A second bend 1010E of the "S" shaped compression blade 1010D may be activated as further pressure is applied. The third bend 1010F of the "S" shaped compression blade 1010D may be activated when a high-pressure force is applied.

The compression blade 1010 may be directly attached to the mounting chassis 1006. An attachment device 1048 may be used to secure the compression blade 1010 to the mounting chassis 1006. In accordance with one embodiment, the attachment device 1048 may allow a user to removably mount the compression mechanism 1004 to the mounting plate 1018. The attachment device 1024 may include dampening material to absorb the force applied to the target 1002. The attachment device 1024 may be a locking screw device or similar mechanism having rubberized washers, foam or similar devices as the dampening material.

The mounting chassis 1006 and fasteners 1008 may be used to secure the striking apparatus 1000" to the door end assembly 1030. The mounting chassis 1006 may be removably coupled to the door end assembly 1030. The fasteners 1008, which may come in a variety of forms and shapes, may be used to secure the striking apparatus 1000 to the door end assembly 1030 through the mounting chassis 1006. Through the fasteners 1008, the mounting chassis 1006 may be secured, yet easily unhinged or removed such that the striking apparatus 1000 may be moved or relocated to another location.

The foregoing description is provided to enable any person skilled in the relevant art to practice the various embodiments described herein. Various modifications to these embodiments will be readily apparent to those skilled in the relevant art, and generic principles defined herein may be applied to other embodiments. Thus, the claims are not intended to be limited to the embodiments shown and described herein, but are to be accorded the full scope consistent with the language of the claims, wherein reference to an element in the singular is not intended to mean "one and only one" unless specifically stated, but rather "one or more." All structural and functional equivalents to the elements of the various embodiments described throughout this disclosure that are known or later come to be known to those of ordinary skill in the relevant art are expressly incorporated herein by reference and intended to be encompassed by the claims. Moreover, nothing disclosed herein is intended to be dedicated to the public regardless of whether such disclosure is explicitly recited in the claims.

What is claimed is:

1. An exercise assembly comprising: a target; a plurality of compression blades coupled to the target wherein each of the plurality of compression blades comprises: a "U" shaped section, wherein a first leg of each of the "U" shaped sections is coupled to the target; a curve section extending up from and curved down and away from a second leg of the "U" shaped section; and a vertical leg extending down from the curve section; a mounting plate coupled to the plurality of compression blades; a mounting chassis coupled to the mounting plate securing the exercise assembly to a building structure; and a plurality of fasteners coupled to the mounting chassis securing the exercise assembly to the building structure; wherein the mounting chassis and the plurality of fasteners allow compression of the exercise assembly in a forward, rearward and side to side direction relative to the building structure.

2. The exercise assembly of claim 1, comprising a resistance device attached to at least one the plurality of compression blades, the resistance device limiting an amount of a compression of the "U" shaped section of the at least one of the plurality of compression blades.

3. The exercise assembly of claim 2, wherein the resistance device comprises: a block of material; and a plurality of slots formed through the block, wherein each of the plurality of slots is of a width to allow one of the first legs or second legs of the "U" shaped section of each of the plurality of compression blades to be inserted therethrough securing the block of material between the first legs and the second leg of the "U" shaped section.

4. The exercise assembly of claim 2, wherein the block of material is formed of rubber, hardened foam.

5. The exercise assembly of claim 1, comprising a shock absorbing device coupled to each of the first legs of the "U" shaped sections.

6. The exercise assembly of claim 1, comprising a mounting unit coupled to the vertical leg of each of the plurality of compression blades, securing each of the plurality of compression blades to the mounting plate, wherein the mounting plate has a channel formed therethrough, a shock absorbing member positioned within the channel of the mounting plate.

7. The exercise assembly of claim 1, wherein the target comprises: a center section, the center section formed of an elongated member which is planer, a bottom area of the center section angled inwards; and a pair of side sections, wherein each of the pair of side sections extends from opposing sides of the center section, each of the pair of side sections extending at a same angle, a bottom area of each of the pair of side sections angled inwards at a same angle as the bottom area of the center section.

8. The exercise assembly of claim 1, comprising a backplate attached to a rear surface of the target for securing the plurality of compression blades, the backplate having a plurality of perforations formed therethrough for dampening noise levels when the target is struck.

9. The exercise assembly of claim 1, wherein the mounting chassis comprises: a first plate; a pair of angled plates, wherein each of the pair of angled plate is attached to opposing sides of the first plate, the pair of angled plates angle out and away from the first plate at a same angle; and a pair of "L" shaped plates, wherein one of the pair of "L" shaped plates extend up from an end of each of the pair of angled plates forming the mounting chassis.

10. The exercise assembly of claim 1, wherein each of the plurality of fasteners comprises: a knob; a threaded shaft attached to the knob; and a door trim holder.

11. An exercise assembly comprising: a target; a plurality of compression blades coupled to the target, wherein each of the plurality of compression blades comprises: a "U" shaped section, wherein a first leg of the "U" shaped section is coupled to the target; a curve section extending up from and curved down and away from a second leg of the "U" shaped section; and a vertical leg extending down from the curve section; a mounting plate coupled to the plurality of compression blades; a mounting unit coupled to each of the vertical legs of the plurality of compression legs securing the respective compression blade of the plurality of compression blades to the mounting plate, wherein the mounting plate has a channel formed therethrough, a shock absorbing member positioned within the channel; a mounting chassis coupled to the mounting plate securing the exercise assembly to a building structure; and a plurality of fasteners coupled to the mounting chassis and securing the exercise assembly to the building structure.

12. The exercise assembly of claim 11, comprising a resistance device attached to at least one of the plurality of compression blades, the resistance device limiting an amount of compression of the "U" shaped section of the at least one of the plurality of compression blades.

13. The exercise assembly of claim 12, wherein the resistance device comprises: a block of material, wherein the block of material is formed of rubber, hardened foam; and a plurality of slots formed through the block, wherein each of the plurality of slots is of a width to allow one of the first legs or the second leg of the "U" shaped section of each of the plurality of compression blades to be inserted therethrough securing the block of material between the first leg and the second legs of the "U" shaped section of each of the plurality of compression blades.

14. The exercise assembly of claim 11, comprising a shock absorbing device coupled to each of the first legs of the "U" shaped section of each of the plurality of compression blades.

15. The exercise assembly of claim 11, wherein the target comprises: a center section, the center section formed of an elongated member which is planer, a bottom area of the center section angled inwards; and a pair of side sections, wherein each of the pair of side sections extends from opposing sides of the center section, each of the pair of side sections extending at a same angle, a bottom area of each of the pair of side sections angled inwards at a same angle as the bottom area of the center section.

16. The exercise assembly of claim 11, comprising a backplate attached to a rear surface of the target for securing the plurality of compression blades, the backplate having a plurality of perforations formed therethrough dampen noise levels when the target is struck.

17. The exercise assembly of claim 11, wherein the mounting chassis comprises: a first plate; a pair of angled plates, wherein each of the pair of angled plate is attached to opposing sides of the first plate, the pair of angled plates angle out and away from the first plate at a same angle; and a pair of "L" shaped plates, wherein one of the pair of "L" shaped plates extend up from an end of each of the pair of angled plates forming a multi-angle mounting chassis.

18. The exercise assembly of claim 11, wherein each of the fasteners comprises: a knob; a threaded shaft attached to the knob; and a door trim holder.

19. An exercise assembly comprising: a target, wherein the target comprises: a center section, the center section formed of an elongated member which is planer, a bottom area of the center section angled inwards; and a pair of side sections, wherein each of the pair of side sections extends from opposing sides of the center section, each of the pair of side sections extending at a same angle, a bottom area of each side section angled inwards at a same angle as the bottom area of the center section; a plurality of compression blades coupled to the target, wherein each of the plurality of compression blades comprises: a "U" shaped section, wherein a first leg of the "U" shaped section of each of the plurality of compression blades is coupled to the target; a curve section extending up from and curved down and away from a second leg of the "U" shaped section of each of the plurality of compression blades; and a vertical leg extending down from the curve section; a shock absorbing device coupled to each of the first leg of the "U" shaped section of each of the plurality of compression blades; a resistance device attached to at least one of the plurality of compression blades, the resistance device limiting an amount of compression of the "U" shaped section of the at least one of the plurality of compression blades, wherein the resistance device comprises: a block of material, wherein the block of material is formed of rubber, hardened foam; and a plurality of slots formed through the block of material, wherein each of the plurality of slots is of a width to allow one of the first leg or the second legs of the "U" shaped section of each of the plurality of compression blades to be inserted therethrough securing the block of material between the first leg and the second legs of the "U" shaped section of each of the plurality of compression blades; a mounting plate coupled to the plurality of compression blades; a mounting unit coupled to the vertical leg securing a compression blade to the mounting plate, wherein the mounting plate has a channel formed therethrough, a shock absorbing member positioned within the channel; a mounting chassis coupled to the mounting plate securing the exercise assembly to a building structure; wherein the mounting chassis comprises: a first plate; a pair of angled plates, wherein each of the pair of angled plate is attached to opposing sides of the first plate, the pair of angled plates angle out and away from the first plate at a same angle; and a pair of "L" shaped plates, wherein one of the pair of "L" shaped plates extend up from an end of each of the pair of angled plates forming the mounting chassis; and a plurality of fasteners coupled to the mounting chassis and securing the exercise assembly to the building structure.

* * * * *